US010068464B2

(12) United States Patent
Devlin

(10) Patent No.: US 10,068,464 B2
(45) Date of Patent: Sep. 4, 2018

(54) METHOD FOR ADDING A SECURITY CODE TO MULTIPLE RECEIVERS DURING POWER-UP

(71) Applicant: Loto Lighting LLC, Somerville, MA (US)

(72) Inventor: Thomas E. Devlin, Winchester, MA (US)

(73) Assignee: Formalighting LLC, Alpharetta, GA (US)

( * ) Notice: Subject to any disclaimer, the term of this patent is extended or adjusted under 35 U.S.C. 154(b) by 0 days.

(21) Appl. No.: 15/357,202

(22) Filed: Nov. 21, 2016

(65) Prior Publication Data

US 2017/0148308 A1 May 25, 2017

Related U.S. Application Data

(60) Provisional application No. 62/257,910, filed on Nov. 20, 2015.

(51) Int. Cl.
*G08C 17/02* (2006.01)
*G08C 23/04* (2006.01)

(52) U.S. Cl.
CPC ..... *G08C 17/02* (2013.01); *G08C 23/04* (2013.01); *G08C 2201/20* (2013.01)

(58) Field of Classification Search
CPC .... G08C 17/02; G08C 23/04; G08C 2201/20; G08C 2201/70; G08C 2201/71
USPC ..... 340/10.28, 10.29
See application file for complete search history.

(56) References Cited

U.S. PATENT DOCUMENTS 5,933,090 A * 8/1999 Christenson ..... G07C 9/00817 307/10.2
5,945,936 A * 8/1999 Issa ..... B60R 25/1004 340/12.23
6,049,289 A * 4/2000 Waggamon ..... G07C 9/00309 340/5.23
6,655,817 B2 * 12/2003 Devlin ..... F21V 21/15 362/233
6,721,552 B1 * 4/2004 Jamieson ..... H04W 48/16 370/351
7,024,119 B1 * 4/2006 Mier-Langner ..... G08C 23/04 340/12.29

(Continued)

*Primary Examiner* — Edwin Holloway, III
(74) *Attorney, Agent, or Firm* — Occhiuti & Rohlicek LLP

(57) ABSTRACT

A method for configuring a first remotely-controlled device from a plurality of remotely-controlled devices to execute a function in response to a signal from a remote-controller by executing a set of steps at the first remotely-controlled device, wherein said set of steps comprises power cycling said first remotely-controlled device, said power cycling initiating a pairing period, during said pairing period, receiving, from said remote-controller, a first signal, wherein said first signal includes a first security code, and storing said first security code, said method further comprising, after said pairing period, receiving a second signal, said second signal carrying a second security code, comparing said second security code with said first security code, and, in response to said comparison, selecting an action selected from the group consisting of ignoring said second signal and carrying out said function in response to said second signal.

20 Claims, 7 Drawing Sheets

(56) References Cited

U.S. PATENT DOCUMENTS

| | | | | |
|---|---|---|---|---|
| 7,397,342 | B2 * | 7/2008 | Mullet | G07C 9/00182 340/12.5 |
| 9,146,020 | B2 * | 9/2015 | Devlin | F21S 8/038 |
| 2003/0107888 | A1 * | 6/2003 | Devlin | F21V 21/15 362/233 |
| 2004/0177279 | A1 * | 9/2004 | Domenz | G07C 9/00817 340/5.52 |
| 2004/0240395 | A1 * | 12/2004 | Gauthier | G08C 17/02 370/254 |
| 2005/0088275 | A1 * | 4/2005 | Valoteau | G08C 19/28 340/3.1 |
| 2005/0231134 | A1 * | 10/2005 | Sid | H05B 37/0272 315/294 |
| 2011/0148685 | A1 * | 6/2011 | Welten | H05B 37/0272 341/176 |
| 2014/0056010 | A1 * | 2/2014 | Devlin | F21S 8/038 362/418 |

* cited by examiner

METHOD FOR ADDING A SECURITY CODE TO MULTIPLE RECEIVERS DURING POWER-UP

CROSS REFERENCE TO RELATED APPLICATION

This application claims the benefit of the Nov. 20, 2015 priority date of U.S. Provisional Application No. 62/257,910, the contents of which are herein incorporated by reference in their entirety.

FIELD OF INVENTION

This invention relates to controlling light-fixtures, and in particular, to using a single remote-controller for controlling multiple identical light-fixtures.

BACKGROUND

Most simple unidirectional remote-controlled systems using infrared or radio include one remote-controller that is paired with one remotely-controlled device. In some instances, there may be two or more identical remotely-controlled devices within range of that remote-controller's transmitter. In such cases, it may be necessary to prevent that transmitter from controlling a second device within its transmission range. This is a common problem in, for example, a house having multiple remote-controlled ceiling fans.

One solution to this problem includes setting a code on a dip switch on the device being controlled so that it matches a corresponding code that has been set on the remote-controller's transmitter. This permits operation of two remote-controllers for two different remotely-controlled devices without interference between them.

In some remote-controlled systems, this pairing is carried out by having a learning button on the device. In these cases, pressing the learning button initiates a sequence during which pairing can occur.

In many cases, it is useful to be able to control multiple identical remotely-controlled devices at once. For example, in lighting systems, it is useful to have the ability to dim or turn off selected groups of light-fixtures. In most cases, this is carried out by placing a group of light-fixtures to be controlled on the same electrical circuit and wiring that circuit to a dimmer circuit mounted on a nearby wall or panel. Any other groups of light-fixtures would be placed on additional circuits, each wired to a dedicated dimmer or switch.

This solution suffers from a lack of flexibility as well as difficulty in installation.

In principle, one could set dip switches on each of the light-fixtures involved. However, this is a laborious undertaking when many light-fixtures are involved. Moreover, the light-fixtures themselves may be mounted out of reach, thus making the task dangerous as well as laborious.

SUMMARY OF THE INVENTION

In another aspect, the invention features pairing a remote-controller with selected remotely-controlled device from a plurality of remotely-controlled devices. These remotely-controlled devices are divided between a first subset and a second subset, with the first subset having at at least one remotely-controlled device. Each remotely-controlled device has the ability to be paired with the remote-controller.

The pairing procedure includes interrupting and then restoring power to the remotely-controlled devices. The restoration of power initiates a pairing period. The procedure includes the step of preventing any remotely-controlled device in the second subset from exercising its ability to be paired with the remote-controller during the pairing period. In effect, any remotely-controlled device in that second subset is masked. After having prevented any remotely-controlled device in the second subset from exercising its ability to be paired with the remote-controller during the pairing period, the pairing method continues with transmitting, to all of the remotely-controlled devices, a signal that includes a first security code. The behavior of the remotely-controlled devices in the two subsets will now differ. Those in the first subset will store the first security code, as a result of which, they become paired. However, as a result of having been prevented from exercising their ability to be paired, any remotely-controlled device in the second subset will remain unpaired with the remote-controller.

In some practices, preventing any remotely-controlled device in the second subset from exercising its ability to be paired with the remote-controller during the pairing period includes separating the remotely-controlled device in the second subset from a power supply. As a result, upon restoring power to the first subset, the remotely-controlled device in the second subset remains separated from the power supply. Among these practices are those that also include restoring power to the remotely-controlled device in the second subset after lapse of the pairing period.

Other practices of the invention include, during the pairing period, targeting a remotely-controlled device in the first subset with a visual signal. In these practices, the step of preventing any remotely-controlled device in the second subset from exercising its ability to be paired with the remote-controller during the pairing period includes refraining from targeting any remotely-controlled device in the second subset with the visual signal during the pairing period. Among these practices are those in which targeting a remotely-controlled device in the first subset with a visual signal includes targeting the remotely-controlled device in the first subset with a laser.

Yet other practices further including receiving a signal from the remote-controller, comparing a security code in the signal with the stored security code, and carrying out a function in response to the signal.

A variety of functions can be carried out in response to receiving a suitable signal from the remote-controller. These include changing an intensity of light emitted by the remotely-controlled device, causing the remotely-controlled device to transition between a first state and a second state, causing the remotely-controlled device to rotate, causing a change in direction of light emitted by the remotely-controlled device, changing the light's color or its beamwidth, and of course, simply turning the light on or off. In cases were the remotely-controlled device is something other than a light-fixture, other functions are possible. For example, for a ceiling fan, the function may be to adjust the speed or to turn it on or off. When the remotely-controlled device is a set of blinds, the function may be to open and close the blinds.

Yet other practices include, at a remotely-controlled device in the second subset, receiving a signal from a remote-controller and ignoring the signal.

Any number of remotely-controlled devices can be in the second subset. In fact in some practices, there are no remotely-controlled devices in the second subset at all. Thus, the second subset is an empty set.

Among the practices of the invention are those in which the remotely-controlled devices are chosen to be light-fixtures, those in which they are chosen to be ceiling fans, air-conditioners, blinds, or even just remotely-controlled controllers that control other devices.

In one aspect, the invention permits an owner to program a code to control remotely-controlled devices by cycling power. This particular method promotes security. For example, when implemented in a semi-public area such as a store, it makes it difficult for a vandal to use his own remote-controller to essentially hijack control over the remotely-controlled devices since the vandal would both not have the code and also not have access to the power switch.

The methods and systems described herein also permit light-fixtures throughout an entire store or an area within a store to be easily programmed to respond to their own button codes. This allows two adjacent stores, or regions of a store, to adjust light-fixtures without interfering with each other. Moreover, if one changes the code on the transmitter, or one has forgotten it, it is a simple matter to pair the light-fixtures to the transmitter all over again with a new code.

In other embodiments, all remotely-controlled devices have a sensor to detect a targeted wireless-signal, such as beam of laser light or infrared light. These remotely-controlled devices are dormant until they detect such a signal.

The use of a targeted visual-signal makes it easier pair light-fixtures within a particular area. In this embodiment, on can power cycle the light-fixtures, after which one can activate selected light-fixtures using the targeted visual-signal. This will cause only the remotely-controlled devices activated by the targeted visual-signal to respond to that transmitter. Without the use of a targeted-visual signal, such as a laser, light-fixtures that are on the same electrical circuit would have to be disconnected during the pairing process.

In one aspect, the invention features a method that includes configuring a first device from a plurality of remotely-controlled devices to execute a function in response to a signal from a remote-controller. Such a method includes executing a set of steps at the first device. This set of steps includes causing a change in power supplied to the first device. This change in power starts a pairing period. Then, during the pairing period, the first device receives, from the remote-controller, a first signal. This first signal includes a first security code. The first device then stores the first security code. This completes the configuration process. Then, after the pairing period, the first device receives a second signal. This second signal carries a second security code, which may or may not be the same as the first security code. The first device then compares the second security code with the first security code. In response to the comparison, it either ignores the second signal or carries out the function in response to the second signal.

Practices of the method include those that include, during the pairing period, receiving a visual signal that causes the first device to transition out of a dormant state and into a receiving state in which the first device is susceptible to pairing. This signal can be a laser signal or an incoherent beam of light that has been aimed at an optical receiver on the first device. In either case, as a result of having received this visual signal, the first device becomes susceptible to pairing.

Also among the practices of the invention are those in which initiating the pairing period includes causing an interruption of power to the first device. This can include, for example, turning power to the first device off and then turning it back on.

Other practices of the invention also include, prior to the pairing period, setting the first security code on the remote-controller. Among these are practices that further include, prior to the pairing period, changing a dip switch on the remote-controller from a first setting to a second setting. In these practices, the second setting is indicative of at least a portion of the first security code.

In some practices, the devices are light-fixtures. Among these are practices in which the light-fixture is turned on or off, or practices in which it is dimmed.

Among the practices are those in which the function is that of device to transition between a first state and a second state, those in which the function is that of selecting the function to be causing the device to move, and those in which the function is that of selecting the function to be causing the device to rotate.

Also among the practices of the invention are those that include ignoring the second signal and those that include carrying out the function in response to the second signal.

Yet other practices include executing a set of steps at a second device from the plurality of devices. These steps include initiating a pairing period, during the pairing period, receiving, from the remote-controller, the first signal, wherein the first signal includes the first security code, storing the first security code, after the pairing period, receiving a second signal, the second signal carrying a second security code, comparing the second security code with the first security code, and, in response to the comparison, selecting an action selected from the group consisting of ignoring the second signal and carrying out the function in response to the second signal.

Among the foregoing practices are those in which initiating a pairing period at the second device occurs concurrently with initiating a pairing period at the first device, and those in which initiating a pairing period at the second device occurs during the pairing period at the first device.

In yet other practices, initiating a pairing period comprises power cycling the plurality of devices and enabling selected devices from the plurality of devices with a targeted wireless signal.

Additional practices include those in which, during the pairing period, the first device emits an indicator signal indicating that it has transitioned out of a dormant state and into a receiving state in which it is susceptible to pairing.

In another aspect, the invention features dividing remotely-controlled devices between a first set and a second set, preventing all remotely-controlled devices from the second set from being able to pair with a remote-controller, and, during a pairing period, unsuccessfully attempting to pair the remote-controller with all remotely-controlled devices in the second set.

Among the foregoing practices are those that also include, during the pairing period, pairing the remote-controller with remotely-controlled devices in the first set.

In some practices, preventing all remotely-controlled devices from the second set from being able to pair with the remote-controller includes separating the second set from a power supply such that the remotely-controlled devices in the second set are unable to receive power from the power supply when the power supply is supplying power to the first set of remotely-controlled devices.

Yet other practices include interrupting power to a power supply to which the remotely-controlled devices are connected and restoring power to the power supply. This starts a pairing period. Pairing with the remote-controller and unsuccessfully pairing with the remote-controller occur within this pairing period.

In other practices, preventing all remotely-controlled devices from the second set from being able to pair includes refraining from targeting the remotely-controlled devices from the second set with a laser during the pairing period.

Also among the practices are those that include targeting remotely-controlled devices from the first set with a laser during the pairing period and, during the pairing period, pairing with the remotely-controlled devices in the first set. In these practices, preventing all remotely-controlled devices from the second set from being able to pair includes refraining from targeting the remotely-controlled devices from the second set with a laser during the pairing period.

An alternative practice is the converse of the foregoing. This would include targeting remotely-controlled devices from the second set with a laser during the pairing period and, during the pairing period, pairing with the remotely-controlled devices in the first set. In these practices, preventing all remotely-controlled devices from the second set from being able to pair includes targeting the remotely-controlled devices from the second set with a laser during the pairing period.

Yet other practices include targeting remotely-controlled devices from the second set with a laser during the pairing period and, during the pairing period, pairing with the remotely-controlled devices in the first set. In these practices, preventing all remotely-controlled devices from the second set from being able to pair includes targeting the remotely-controlled devices from the second set with a laser during the pairing period.

In essence, the foregoing practices involve using the laser as a tool for designating which ones of the remotely-controlled devices are to be paired and which ones are not to be paired.

In yet another aspect, the invention features a method that includes pairing predetermined ones of a plurality of remotely-controlled devices to a programmable transmitter. Pairing includes providing a unique security code to the predetermined ones of the plurality of remotely-controlled devices. Each remotely-controlled device has a radio or infrared button code. The act of providing includes placing the predetermined ones of the plurality of remotely-controlled devices in a learning mode for a period of time. This includes initiating a power up of the predetermined ones of the remotely-controlled devices, during the period of time, using a programmable transmitter to emit a signal that includes an identifying string to the radio or infrared button code, and at each of the predetermined ones of the remote-controlled remotely-controlled devices that are in learning mode, receiving the signal and storing the identifying string in a memory, thereby pairing the remote-controlled remotely-controlled devices that are in learning mode to the programmable transmitter.

These and other features of the invention will be apparent from the following detailed description and the accompanying figures, in which:

DETAILED DESCRIPTION

Figure 1:
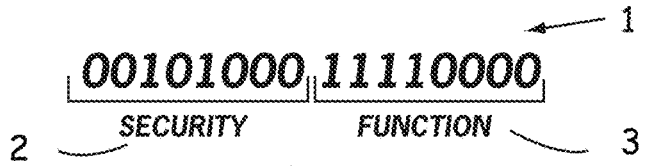
FIG. 1 is a representation of a bit sequence in a button code that is to be transmitted by radio or infrared and that has two parts: a security code, and a button-function code.

As shown in FIG. 1, a typical button code for a radio or infrared remote-controller includes bit sequence 1. The number of bits in the bit sequence 1 varies according to implementation. In some embodiments, there are as many as many as twenty-nine bits. The bit sequence 1 include a security code 2 for remotely-controlled devices, such as remote locks, garage door openers, or light-fixtures, and a permanent set of function-control codes 3.

Figure 2:
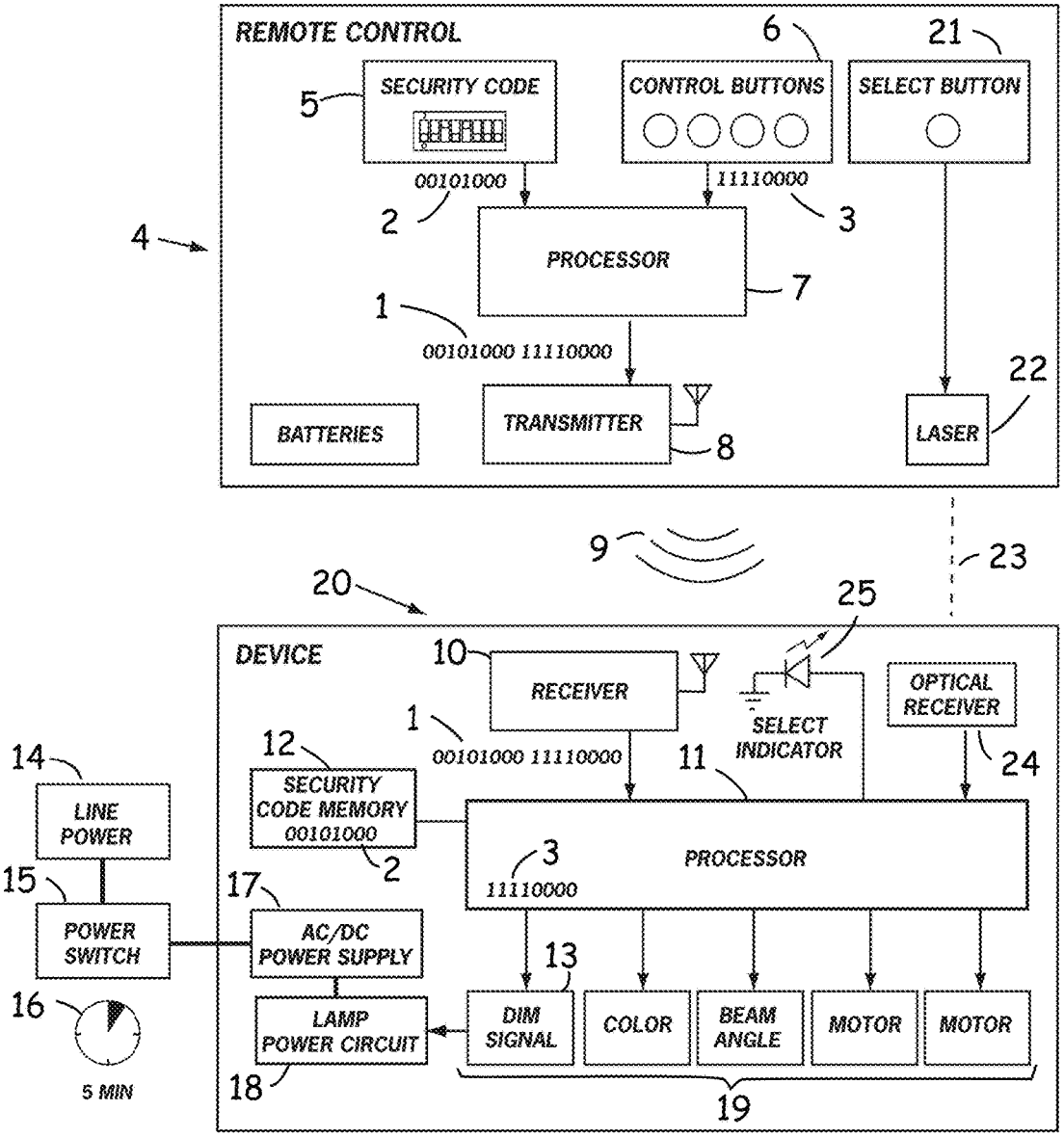
FIG. 2 is a block diagram of a remote-control system in which a receiving light-fixture can be programmed to respond to a button code configured with a user-created security code.

FIG. 2 shows a remote-controller 4 and a light-fixture 20 to be controlled. The remote-controller 4 has a transmitter 8 and the light-fixture 20 has a receiver 10.

In operation, the transmitter 8 converts the bit sequence 1 into a modulated signal. It then sends that signal over a wireless link using a suitable carrier wave 9. In some embodiments, the carrier wave 9 is a radio wave, whereas in others, it is infrared light. In either case, the receiver 10 then demodulates the signal and recovers the bit sequence 1.

The user sets the security code 2 using the remote-controller 4. To do so, the user sets a dip switch to place the security code 2 into a remote-controller's memory 5.

With the security code 2 now in the remote-controller's memory 5, the user then presses a control button 6. Doing so causes the remote-controller's processor 7 to combine the security code 2 with the permanently stored function-control code 3 for that button, thus creating the bit sequence 1 that is ultimately to be sent by the transmitter 8.

On the light-fixture 20, the light-fixture's processor 11 splits the bit sequence 1 and compares the security code 2 with the security code stored in the light-fixture's memory 12. If the security code 2 matches it, the light-fixture 20 performs a control function 19 that matched the function-control code 3. Examples of a control function 19 include sending a signal 13 to a power circuit 8 to dim the light-fixture. Other examples of a control function 19 include adjusting the color of light emitted by the light-fixture 20, the angle in which the beam is directed, the angle of the beam itself, which can be varied from a small angle that yields a small area of illumination to a large angle that yields a larger area of illumination. Other examples include a signal that moves the light-fixture 20. This includes rotating the light-fixture 20 so that the emitted beam points to another location. It also includes translating the light-fixture 20. In either case, this movement is carried out by running one or more motors.

In those cases in which the device being controlled is something other than a light-fixture 20. For example, the device can be a window blind, in which case an example of a control function is operating a motor to open or close the window blind. Or, in cases in which the remotely-controlled device is a ceiling fan, an example of a control function 19 is that of turning the fan on or off, or adjusting its speed.

In some cases, the light-fixture 20 has a dip switch that is set to the security code 2. In other cases, the light-fixture 20 has a button that, when pressed, initiates a learning mode. The learning mode defines a time-period during which the light-fixture 20 is made susceptible to being paired. Pairing, in this case, occurs when the light-fixture 20 receives a signal that contains the security code. This is practical for products in which there is one remote-controller for each remotely-controlled device.

However, in those cases in which a single unidirectional transmitter will control a plurality of light-fixtures 20, these solutions are impractical, especially when there many light-fixtures 20 and/or when some are out of reach.

Another approach is to have the owner use a switch 15 to disconnect power 14 from the light-fixture 20 and to then restore power 14 to the light-fixture 20. This switch 15 is intended to be inaccessible to all but the owner. Doing so initiates a pairing period 16 during which the light-fixture 20 accepts any transmitted bit sequence 1 and stores the security code 2 of that bit sequence 1 in the light-fixture's memory 12. This procedure is referred to herein as "pairing."

After this pairing period is over, the light-fixture 20 will only respond to transmitted sequences that carry a security code 2 that matches that stored in the light-fixture's memory 12. Optionally, after receiving the bit sequence 1 and storing the security code 2, the light-fixture 20 performs the function identified by the function code 3. In an alternative embodiment, the remote-controller 4 has a special pairing button that is used only for pairing.

In some cases, it may be desirable to pair some but not all of the light-fixtures 20 on the same circuit. In such cases, the procedure is to turn off power to the light-fixtures 20, to then disconnect those light-fixtures 20 that are not to be paired, and then to restore power. Pairing can then proceed as described above. Once the light-fixtures 20 have been paired, those that were disconnected can be reconnected.

Another embodiment avoids the inconvenience of having to disconnect light-fixtures 20 by relying on a laser-selection system. In this embodiment, the user points the remote control 4 toward an optical receiver 24 on the light-fixture 20 and presses a select button 21 that activities a laser 22. A resulting laser beam 23 illuminates the optical receiver 24 on the light-fixture 20. This causes the light-fixture's processor 11 to enable the receiver 10 to receive signals. In some embodiments, the light-fixture's processor 11 activates a visual indicator 25 to show that the light-fixture 20 has been activated and is ready to receive a signal. Otherwise, the light-fixture 20 would be dormant and not respond to transmitted signals. This conserves power because the receiver 10 could be turned off, and the light-fixture's processor 11 can be placed into a low-power mode.

The laser-selection system allows light-fixtures 20 that are on the same power circuit to be paired as a group to a unique transmitter or as a zone on a single transmitter. This is particularly useful for dimming regions of a room. The laser-selection system also makes it possible to pair some but not all light-fixtures 20 that are on the same power circuit.

The use of a targeted visual signal is preferable because one can more easily aim it. A laser is particularly preferable because the beam does not fan out with distance. This permits targeting of light-fixtures 20 that are far away, such as light-fixtures 20 mounted on a high ceiling. However, for short distances, it may be practical to have use an incoherent light source instead of a laser.

In the laser-selection system described above, targeting a light-fixture 20 means that that light-fixture 20 will be able to pair with a remote-controller. However, what is important is actually using the laser to partition a set of lighting-fixtures 20 into two subsets, one of which is prevented from pairing. In an alternative operating mode, this could equivalently be carried out by targeting, with a laser, those light-fixtures 20 that are not to be paired with a remote-controller instead of the other way around.

Figure 3:
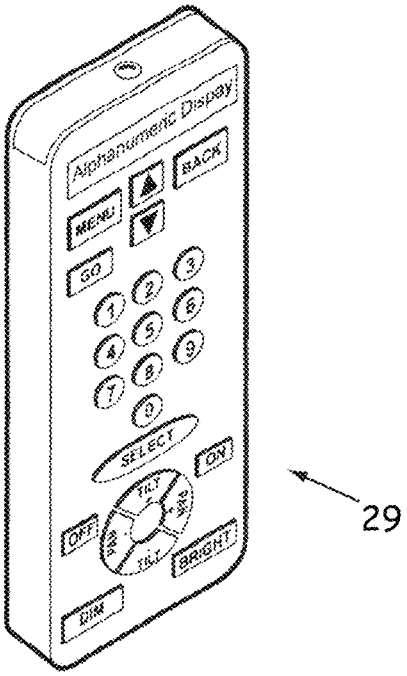
FIG. 3 is a representation of a remote-controller that allows input of a security code via a keypad.

FIG. 3 shows an enhanced remote-controller 29 that has a keypad. Such a keypad can be used to enter a unique security code and to set a zone for dimming. This zone could be recalled and then controlled as a group.

Figure 4:
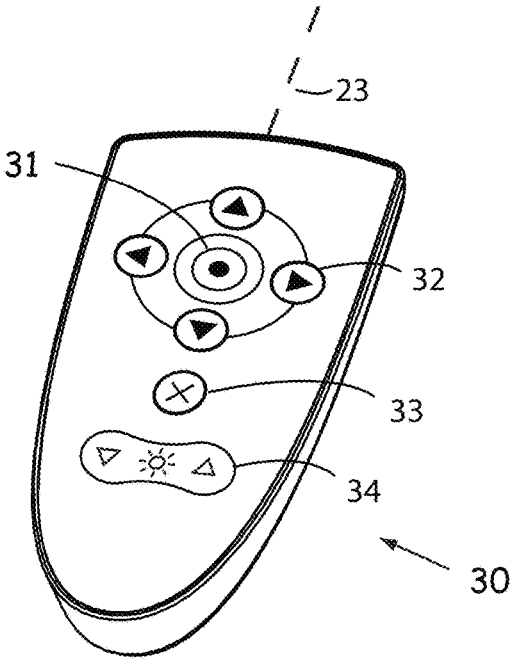
FIG. 4 is a simple remote-controller having laser-selection capability.

FIG. 4 shows a simplified remote-controller 30 that lacks the keypad shown in FIG. 3. The simplified remote-controller 30 has a selection button 31 that, when pressed causes a laser 22 to emit a laser beam 23. Control buttons 32 move a light-fixture up and down or left and right. The simplified remote-controller 30 also features dimming buttons 34. A cancel button 33 transmits a button code that will de-activate any light-fixture 20 that has been activated. Alternatively, the laser beam 23 can be used to de-activate a light-fixture 20.

Figure 5:
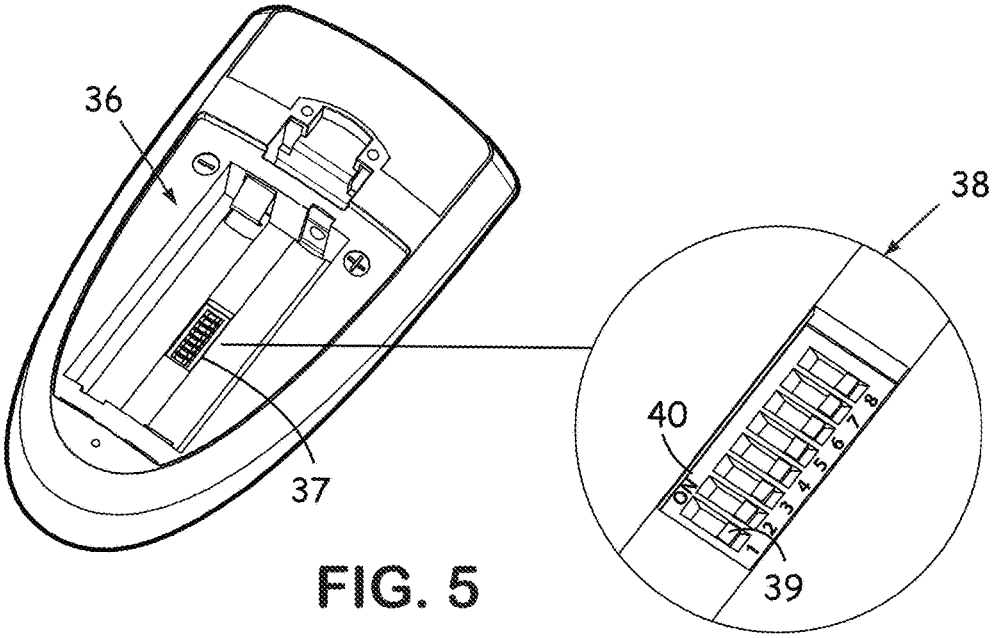
FIG. 5 illustrates how to implement a dip switch in the battery compartment of the remote control of FIG. 4 in a way that permits a user to set the security code.

FIG. 5 shows the battery compartment 36 of the remote-controller 30 shown in FIG. 4 with its cover removed, thus exposing a dip switch 37 on the floor of the battery compartment 36. From a close-up view 38 of the dip switch 37, it is apparent that the user can slide any number of switches 39 from an "off" position to an "on" position 40. The $n^{th}$ switch controls the state of the $n^{th}$ bit in the security code 2. In the example shown the dip switch 37 has been set to the security code "00000000," which could be a factory default setting. An owner can easily open the battery compartment 36, set this dip switch 37 to a new setting, and pair a set of light-fixtures 20 to that remote-controller 30, thus preventing others with a similar remote-controller from controlling those light-fixtures 20.

Figure 6:
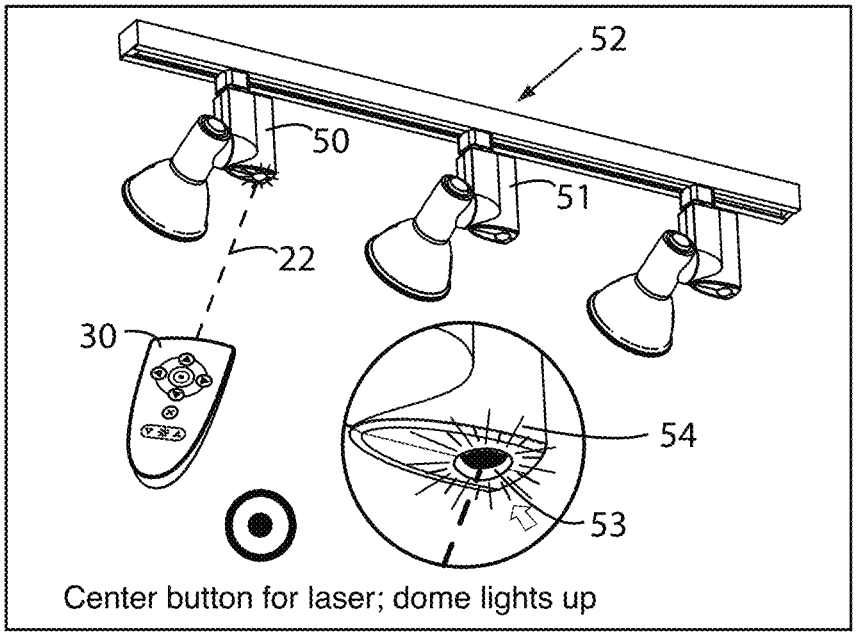
FIG. 6 is an illustration of a laser-selection system in which a light-fixture responds to radio commands only after it as sensed a laser signal directed towards it.
Figure 6:
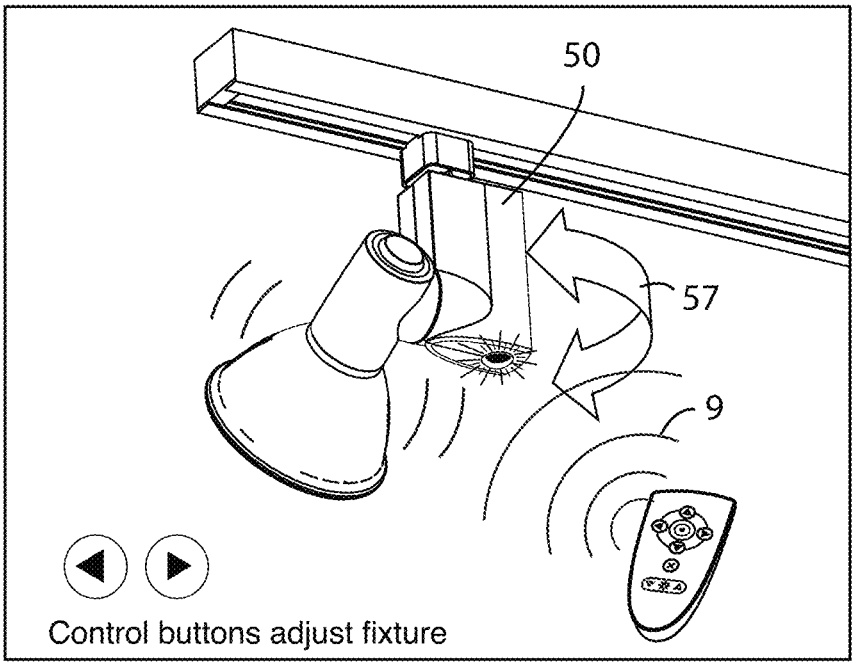

FIG. 6 illustrates a particular embodiment of a laser-selection system in which different light-fixtures 52 respond to a laser beam 23 sent by the remote-controller 30. These can be identical light-fixtures or different kinds of light-fixtures that have been configured to be controlled together as a group.

Pointing a laser beam 23 at a dome 53 on a light-fixture activates an indicator 54 on the dome 53. The indicator 54 indicates that the light-fixture 50 is susceptible to responding to a carrier wave 9. Other light-fixtures 51, whose domes 53 have not been targeted by a laser beam 23, will not respond to this carrier wave 9. This is particularly useful when an individual light-fixture 50 needs to be rotated along a rotation direction 57. However, it is also possible to have the laser beam 23 illuminate several domes 53 of different light-fixtures 50. The corresponding light-fixtures will then operate as a unit. This is useful when one wishes to dim several but not all light-fixtures at once.

Figure 7A:
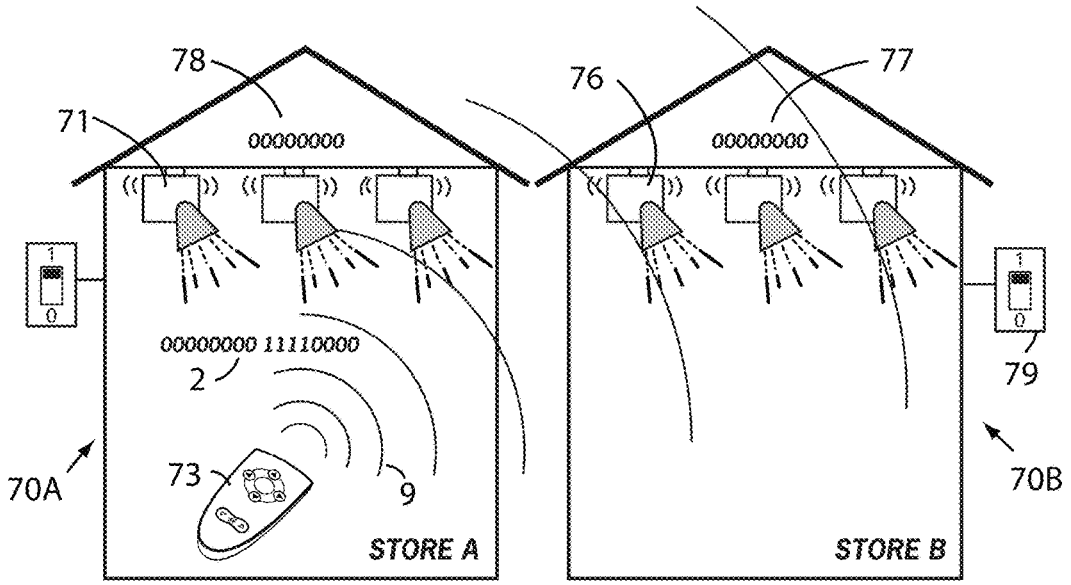
FIG. 7A is a representation of two adjacent stores in which one store's light-fixtures are responding to the other store's remote-controller.

FIG. 7A illustrates a case in which a first store 70A and a second store 70B either has identical light-fixtures or a set of different light-fixtures with identical control hardware. The use of a store is only for example. It is understood that similar difficulties can arise in any pair of neighboring spaces.

In FIG. 7A, the light-fixtures and the transmitter 73 do not use a laser-selection system. If all light-fixtures in the first store 70A have a security code 78 that matches the security code 77 of all the light-fixtures in the second store 70B, then a carrier wave 9 from a remote-controller 73 in the first store 70A would find itself controlling the light-fixtures in both stores at once. The only way to prevent this interference would be to turn off the power 79 to the light-fixtures in the second store 70B.

Figure 7B:
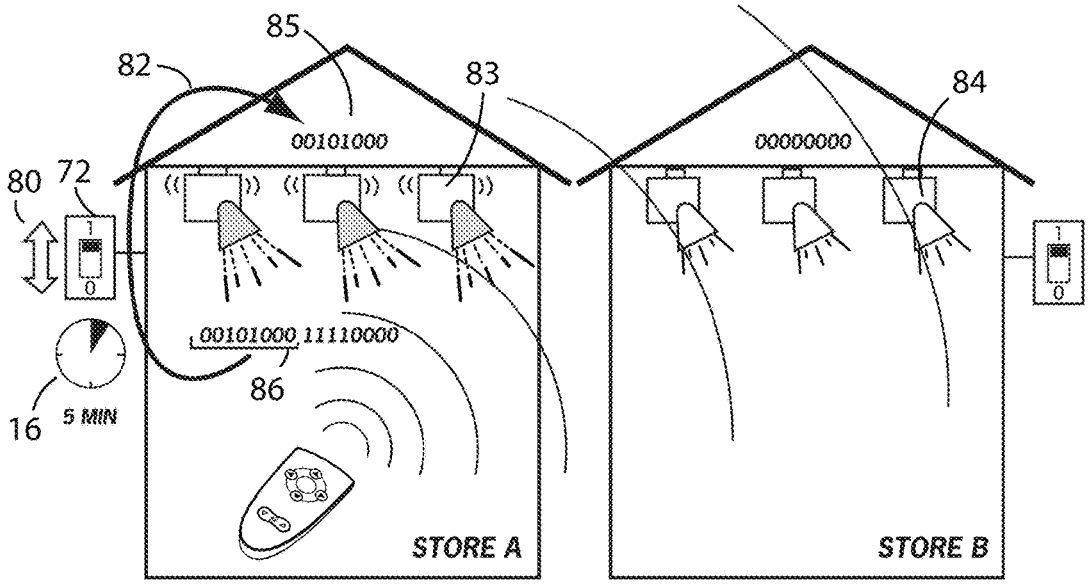
FIG. 7B is a representation of a method of programming the security code of the light-fixtures of a store during a short pairing interval that begins when power is turned back on after having been turned off.

FIG. 7B illustrates how the pairing function overcomes this difficulty. As shown in FIG. 7B, a first store has first light-fixtures 83 and a second store has second light-fixtures 84.

The process begins with setting a new security code 86 in the remote-controller 73. Then, one uses a switch 72 to turn off power to the first light-fixtures 83 and to turn it back on again. This begins a short pairing time period 16 during which the first light-fixtures 83 will pair with a new security code 86 that has been set in the remote-controller 73. This causes storage of a copy 85 of the new security code 86 in the memories of the first light-fixtures 83. The second light-fixtures 84 will not have been power cycled. Therefore, they will not store the new security code 86. As shown in FIG. 7B, the second light-fixtures 84 still have the factory default security code.

Figure 7C:
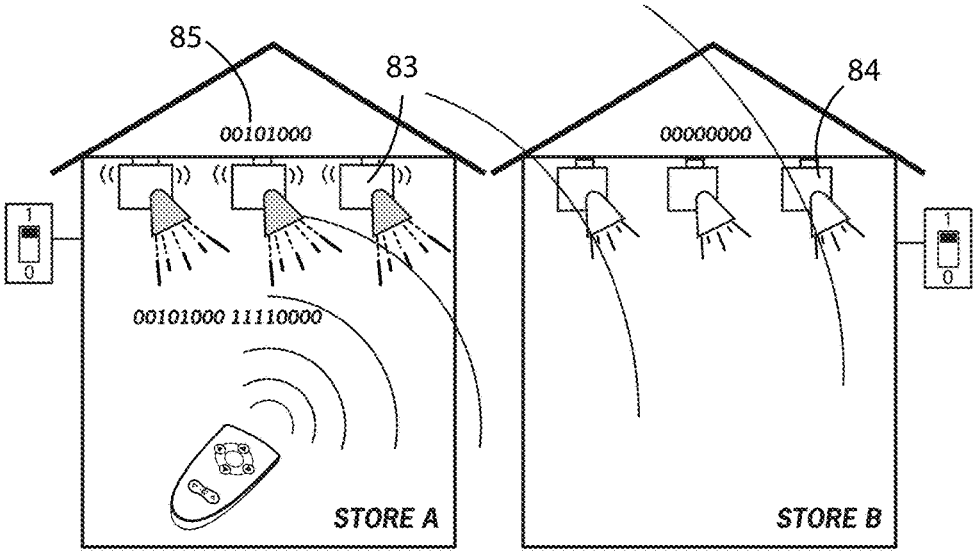
FIG. 7C is a representation of how different security codes permit light-fixtures in one store from being inadvertently controlled by the wrong remote-controller.

Referring now to FIG. 7C, when the remote-controller 73 transmits a carrier wave 9, only the first light-fixtures 83 will respond. The second light-fixtures 84 will ignore the carrier wave 9.

Although FIGS. 7A-7C depict two separate stores 70A, 70B, they could also represent spaces within a single store that are on separate power circuits. This would be useful in those cases in which the remote-controller 73 is preferred over a wall dimmer.

Figure 8A:
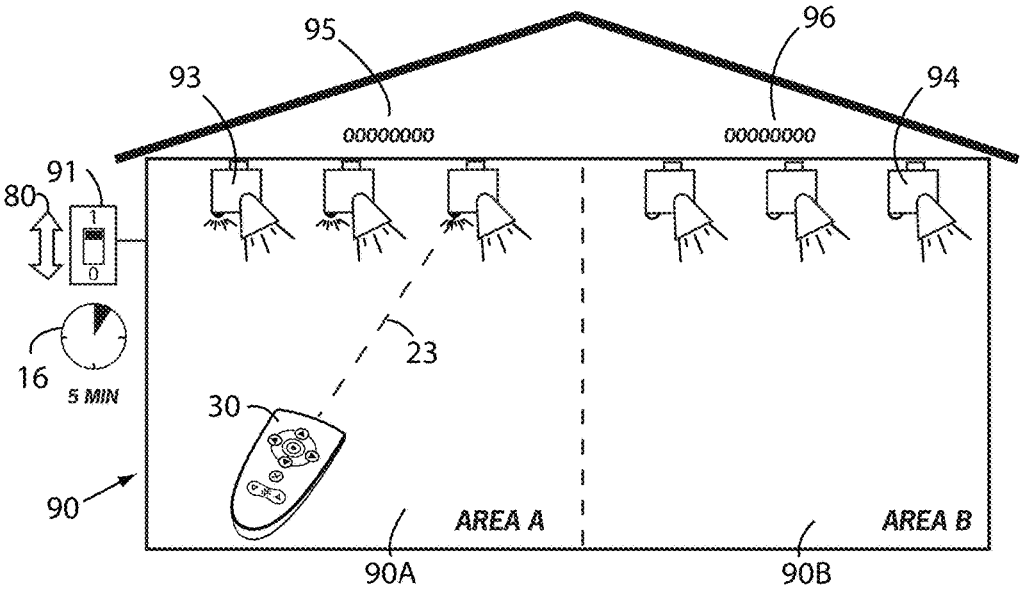
FIG. 8A is a representation of a store in which light-fixtures in first and second areas are on the same electrical circuit, and light-fixtures in the first area are being selected by a laser beam emitted by a remote-controller.
Figure 8B:
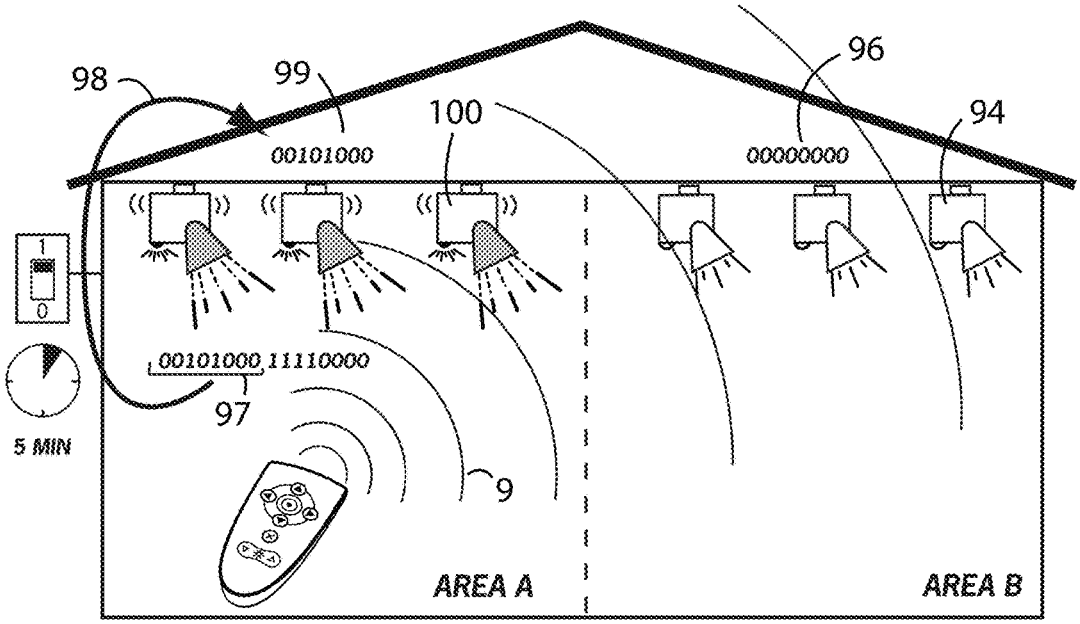
FIG. 8B shows some light-fixtures that have been selected by the laser being paired during a short pairing interval after restoration of power.

FIG. 8A and FIG. 8B illustrate pairing of light-fixtures using a laser-selection system.

FIG. 8A shows a store 90 with first light-fixtures 93 in a first region 90A and second light-fixtures 94 in a second region 90B. There is only one power switch 91 for all the light-fixtures 93, 94 in the store 90. A first security code 95 for the first light-fixtures 93 is initially the same as a second security code 96 for the second light-fixtures 94.

The owner then uses the sole power switch 91 to cycle power off. This initiates a short pairing period 16. During this pairing period, the user selects the first light-fixtures 93 using the laser signal 23 on the remote-controller 30. This procedure renders the first light-fixtures 93 susceptible to pairing. Meanwhile, the second light-fixtures 94 remain dormant.

In the second step, as shown in FIG. 8B, the remote-controller 30, which has been programmed with a new security code 97, transmits a carrier wave 9 that carries this new security code 97. As a result, the first light-fixtures 93 will pair with the remote-controller 30 and store the new security code 99. In some embodiments, in addition to storing the new security code 99, the first light-fixtures 93 will also execute a function as specified in function code 3 carried by the carrier wave 9. Meanwhile, the second light-fixtures 94 remain dormant and retain their stored codes.

Figure 8C:
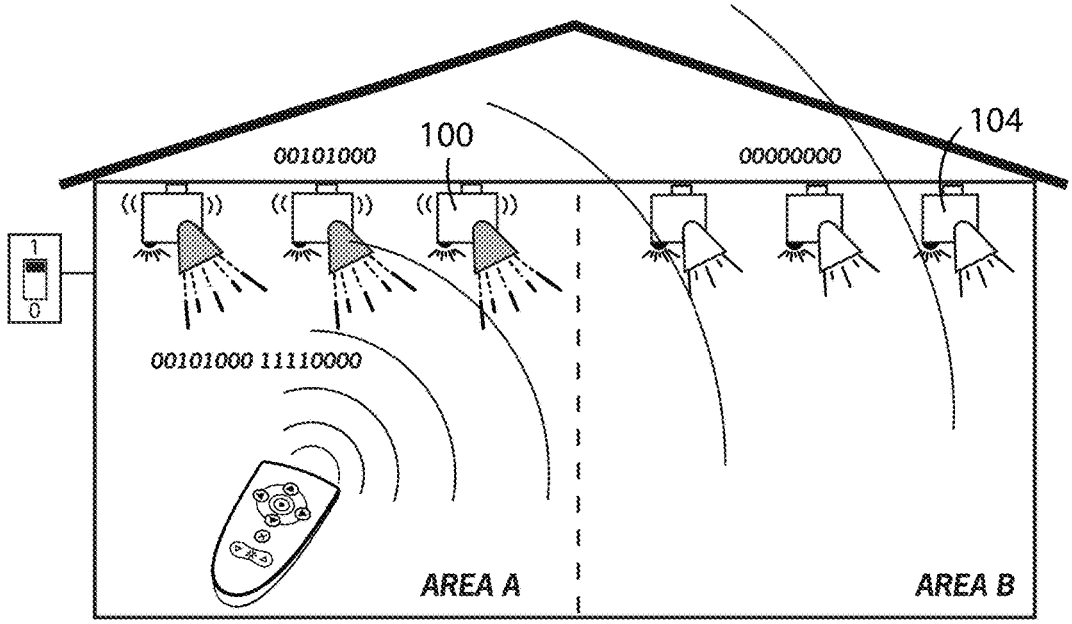
FIG. 8C is a representation of the light-fixtures in a second area that are not responding to radio signals in another area, even when they have been selected by a laser.

FIG. 8C shows first light-fixtures 100 in a first region and second light-fixtures 104 in a second region. The first light-fixtures 100 have been programmed to have a new security code whereas the second light-fixtures 104 retain the factory default security code. As a result, the first light-fixtures 100 will respond to the remote-controller 4 and the second light-fixtures 104 will not. This feature is particularly helpful for situations where lighting designers are working all at once in a store adjusting light-fixtures.

Figure 9:
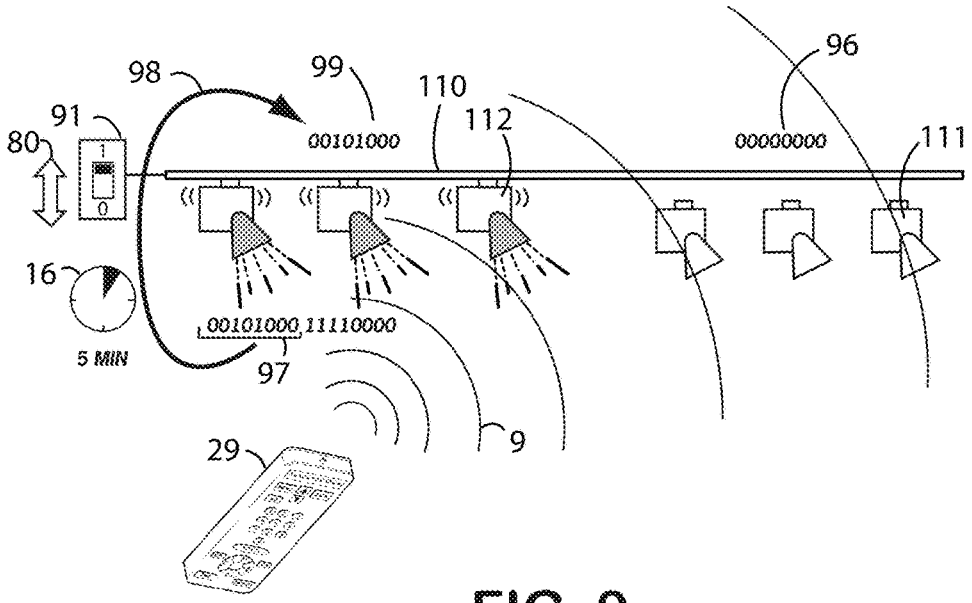
FIG. 9 is an alternate method to selectively program light-fixtures on the same circuit by disconnecting light-fixtures so that they will not pair with the new security code.

FIG. 9 illustrates how the pairing system could be used to create dimming zones on a single light power track 110 having first light-fixtures 111 and second light-fixtures 112 using a single programmable remote-controller 29 instead of multiple remote-controllers with different dip switch settings.

The process begins with disconnecting the first light-fixtures 111. Then, the power switch 91 disconnects and reconnects the second light-fixtures 112. During a short pairing period 16 that follows, the remote-controller 29 will transmit a new security code 97. The second light-fixtures 112, having been placed into a state in which they are susceptible to pairing, will store a copy 99 of the security code 97 in the light-fixture's memory. When the first light-fixtures 111, they can be programmed to a different zone using the old security code 96. The first and second light-fixtures 111, 112 can then be dimmed separately without the need for separate dimming circuits.

Figure 10:
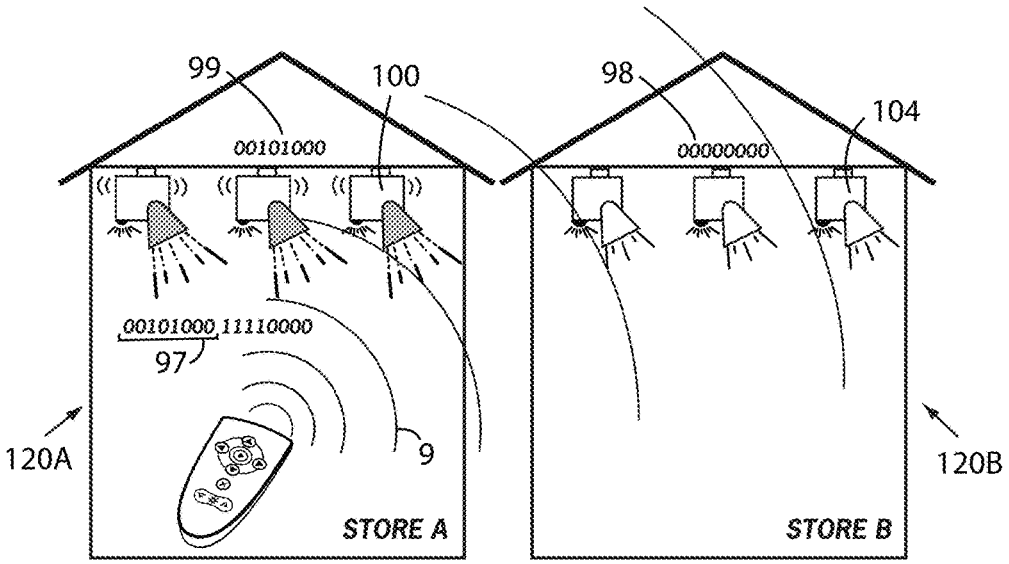
FIG. 10 is a representation of two stores where laser selected light-fixtures are being adjusted at the same time, but will only respond to the remote control that was paired in that store.

FIG. 10 illustrates how first light-fixtures 100 in a first store 120A can be controlled by a remote-controller 30 without affecting second light-fixtures 104 in an adjacent second store 120B.

When the security code 99 of all the first light-fixtures matches a transmitted code 97 from the remote-controller 30, and when the laser-selection system is available, there is no need for separate zones within the first store 120A. The laser can be used to select a set of light-fixtures to be dimmed. Or, the laser can be used to select one light-fixture at a time. This is useful for moving the light-fixture to redirect its beam. None of this activity will affect the second light-fixtures 104 in the nearby second store 120B even though they are well within range of the transmitted carrier wave 9 and have been activated by a laser in the unlikely case that someone is adjusting light-fixtures at the same time. This is because the security code 96 for all the light-fixtures in the store does not match.

The foregoing description describes in detail the case in which the remotely-controlled devices are light-fixtures. However, it should be understood that the techniques described herein are applicable to other kinds of remotely-controlled devices. In addition to the foregoing examples, such remotely-controlled devices can include, without limitation, ceiling fans, window blinds, and remotely-controlled controllers that themselves control other devices. In addition, the remotely-controlled device can be a lamp, a light, a track for holding lamps or lights, a string for holding lamps or lights, a string that contains both lamps and lights, a track that contains both lamps and lights, and a remotely-controlled motor.

Having described the invention, and a preferred embodiment thereof, what I claim as new, and secured by Letters Patent is:

1. A method to control remote-controllable devices, the method comprising:

selecting at least one of one or more remote-controllable devices using an optical transmission from a remote-control device, the optical transmission received by a respective optical sensor at the at least one of the one or more remote-controllable devices during a time-limited pairing period to program one or more security codes for the selected at least one of the one or more remote-controllable devices, wherein the time-limited pairing period is initiated by resetting power to the one or more remote-controllable devices; and transmitting during the time-limited pairing period a wireless pairing signal from the remote-control device, receivable via a wireless receiver at the at least one of the one or more remote-controllable devices selected using the optical transmission during the time-limited pairing period, the wireless pairing signal comprising information representative of a pre-determined security code, wherein the pre-determined security code is stored in a memory device of the selected at least one of the one or more remote-controllable devices during the time-limited pairing period.

2. The method of claim 1, further comprising:

resetting the power to the one or more remote-controllable devices to initiate the time-limited pairing period, including interrupting power to the one or more remote-controllable devices and subsequently restoring the power to the one or more remote-controllable devices, wherein restoration of the power after interrupting the power to the one or more remote-controllable devices initiates the time-limited pairing period to prevent any other remotely-controlled device, from a plurality of remote-controllable devices, not affected by the interrupting of the power to the one or more remote-controlled devices, from storing the pre-determined security code represented by the information included in the wireless pairing signal transmitted by the remote-control device during the time-limited pairing period.

3. The method of claim 1, further comprising:

transmitting, at a time instance subsequent to the initiating of the time-limited pairing period, a wireless function signal comprising a device code associated with the at least one of the one or more remote-controllable devices, and a function code specifying a function to be performed by a remote-controllable device, the wireless function signal configured to cause only the at least one of the one or more remote-controllable devices with the pre-determined security code stored during the time-limited pairing period to perform the function specified by the wireless function signal in response to a determination that the transmitted wireless function signal includes the device code matching the pre-determined security code.

4. The method of claim 3, wherein the wireless function signal is configured to cause the at least one of the one or more remote-controllable devices to:

compare the device code included in the wireless function signal to the pre-determined security code stored in the memory device of the at least one of the one or more remote-controllable devices during the time-limited pairing period; and perform a function corresponding to the function code included in the wireless function signal in response to a determination that the device code included in the wireless function signal matches the pre-determined security code stored in the memory device of the at least one of the one or more remote-controllable devices.

5. The method of claim 3, wherein the at least one of the one or more remote-controllable device comprises at least one remote-controllable light fixture, and wherein transmitting the wireless function signal comprises transmitting the wireless function signal to cause the at least one remote-controllable light fixture to perform, in response to the determination that the device code included in the wireless function signal matches the pre-determined security code, one or more of: change an intensity of light emitted by said at least one remote-controllable light fixture, change direction of the light emitted by said at least one remote-controllable light fixture, or transition between a first state and a second state of said at least one remote-controllable light fixture.

6. The method of claim 1, wherein selecting the at least one of the one or more remote-controllable devices using the optical transmission comprises:

transmitting from the remote-control device one of: an infrared signal, or a laser signal.

7. The method of claim 1, further comprising:

setting at the remote-control device the pre-determined security code prior to transmitting the wireless pairing signal comprising the information representative of the pre-determined security code.

8. The method of claim 7, wherein setting the pre-determined security code comprises:

setting the pre-determined security code using one or more dip switches provided in the remote-control device.

9. A method to control a remote-controllable device, the method comprising:

initiating a time-limited pairing period to program at least one security code for the remote-controllable device in response to a power resetting applied to one or more remote-controllable devices that include the remote-controllable device;

receiving an optical transmission transmitted by a remote-control device, the optical transmission configured to select the remote-controllable device, from a plurality of remote-controllable devices, for security code programming;

wirelessly receiving a wireless pairing signal from the remote-control device during the time-limited pairing period, the wireless pairing signal comprising information representative of a pre-determined security code; and storing during the time-limited pairing period in a memory device of the remote-controllable device, selected by the optical transmission for programming, the pre-determined security code.

10. The method of claim 9, wherein initiating the time-limited pairing period in response to the power resetting comprises:

initiating the time-limited pairing period in response to interruption of power to the one or more remote-controllable devices and subsequent restoration of the power to the one or more remote-controllable devices, wherein restoration of the power after interruption of the power to the one or more remote-controllable devices prevents any other remote-controllable device, from the plurality of remote-controllable devices, not affected by the interruption of the power to the one or more remote-controlled devices from initiating the time-limited pairing period.

11. The method of claim 9, further comprising:

receiving, at a time instance subsequent to the initiating of the time-limited pairing period, a wireless function signal comprising a device code associated with at least one remote-controllable device, and a function code specifying a function to be performed by the at least one remote-controllable device, the wireless function signal configured to cause the remote-controllable device to perform the function specified by the wireless function signal in response to a determination that the transmitted wireless function signal includes the device code matching the pre-determined security code stored in the memory of the remote-controllable device.

12. The method of claim 11, wherein the remote-controllable device comprises a remote-controllable light fixture, and wherein the method further comprises:

performing, in response to the determination that the device code included in the wireless function signal matches the pre-determined security code, one or more of: changing an intensity of light emitted by the remote-controllable light fixture, changing direction of the light emitted by the remote-controllable light fixture, or transitioning between a first state and a second state of the remote-controllable light fixture.

13. The method of claim 9, wherein receiving the optical transmission transmitted by the remote-control device comprises:

receiving from the remote-control device one of: an infrared signal, or a laser signal.

14. The method of claim 9, wherein the remote-control device is configured to set, using one or more dip switches provided in the remote-control device, the pre-determined security code prior to transmission of the wireless pairing signal comprising the information representative of the pre-determined security code.

15. A remote controllable device comprising:

a controller configured to initiate a time-limited pairing period to program at least one security code for the remote-controllable device in response to a power resetting applied to one or more remote-controllable devices that include the remote-controllable device;

an optical sensor to receive an optical transmission transmitted by a remote-control device, the optical transmission configured to select the remote-controllable device, from a plurality of remote-controllable devices, for security code programming; and a wireless receiver to receive a wireless pairing signal from the remote-control device during the time-limited pairing period, the wireless pairing signal comprising information representative of a pre-determined security code;

wherein the controller is further configured to:

store during the time-limited pairing period in a memory device of the remote-controllable device, selected by the optical transmission for programming, the pre-determined security code.

16. The remote-controllable device of claim 15, wherein the controller configured to initiate the time-limited pairing period in response to the power resetting is configured to:

initiate the time-limited pairing period in response to interruption of power to the one or more remote-controllable devices and subsequent restoration of the power to the one or more remote-controllable devices, wherein restoration of the power after interruption of the power to the one or more remote-controllable devices prevents any other remote-controllable device, from the plurality of remote-controllable devices, not affected by the interruption of the power to the one or more remote-controlled devices from initiating the time-limited pairing period.

17. The remote-controllable device of claim 15, wherein the wireless receiver is further configured to:

receive, at a time instance subsequent to the initiating of the time-limited pairing period, a wireless function signal comprising a device code associated with at least one remote-controllable device, and a function code specifying a function to be performed by the at least one remote-controllable device, the wireless function signal configured to cause the remote-controllable device to perform the function specified by the wireless function signal in response to a determination that the transmitted wireless function signal includes the device code matching the pre-determined security code stored in the memory of the remote-controllable device.

18. The remote-controllable device of claim 17, wherein the remote-controllable device comprises a remote-controllable light fixture, and wherein the controller is further configured to:

cause, in response to the determination that the device code included in the wireless function signal matches the pre-determined security code, one or more of: changing an intensity of light emitted by the remote-controllable light fixture, changing direction of the light emitted by the remote-controllable light fixture, or transitioning between a first state and a second state of the remote-controllable light fixture.

19. The remote-controllable device of claim 15, wherein the optical sensor configured to receive the optical transmission transmitted by the remote-control device is configured to:

receive from the remote-control device one of: an infrared signal, or a laser signal.

20. The remote-controllable device of claim 15, wherein the remote-control device is configured to set, using one or more dip switches provided in the remote-control device, the pre-determined security code prior to transmission of the wireless pairing signal comprising the information representative of the pre-determined security code.

* * * * *